United States Patent [19]

Good et al.

[11] Patent Number: 4,702,091

[45] Date of Patent: Oct. 27, 1987

[54] CUFF MEMBER AND SOCK

[76] Inventors: David S. Good; Daniel H. Good, both of 1634 19th Ave., NE., Hickory, N.C. 28601

[21] Appl. No.: 781,672

[22] Filed: Sep. 30, 1985

[51] Int. Cl.[4] ..... D04B 9/54

[52] U.S. Cl. ..... 66/171; 66/172 E; 66/180; 66/194

[58] Field of Search ..... 66/172 R, 172 E, 173, 66/180, 194, 171

[56] References Cited

U.S. PATENT DOCUMENTS

| | | | |
|---|---|---|---|
| 2,244,153 | 6/1941 | Hanisch | 66/172 R |
| 2,986,025 | 5/1961 | Cormier | 66/172 E |
| 3,013,420 | 12/1961 | Cormier | 66/172 E X |
| 3,039,282 | 6/1962 | Hayes | 66/172 R X |
| 3,142,164 | 7/1964 | Merritt | 66/172 R X |
| 3,162,029 | 12/1964 | Laws et al. | 66/172 E |
| 3,250,095 | 5/1966 | Bird | 66/194 X |
| 3,990,115 | 11/1976 | Nester | 66/172 E X |

*Primary Examiner*—Wm. Carter Reynolds
*Attorney, Agent, or Firm*—Shefte, Pinckney & Sawyer

[57] ABSTRACT

A tubular circularly-knitted cuff member including a plurality of integrally knit alternating coursewise rib portions and intermediate coursewise connecting portions, each rib portion having a set bulky terry yarn and stretchable low denier ground yarn knitted in plated terry stitch construction with an elastic yarn inlaid in alternate stitches to produce a radially-outward rounded terry loop surface and each connecting portion having the ground yarn in a single jersey stitch construction with the elastic yarn inlaid alternately therein. The cuff member is stretchable axially between a relaxed condition with the rib portions closely axially adjacent one another and the connecting portions generally not visible and an extended condition with the rib and connecting portions elongated to space the rib portions axially apart. A method of knitting the cuff member is also disclosed.

10 Claims, 14 Drawing Figures

CUFF MEMBER AND SOCK

BACKGROUND OF THE INVENTION

The present invention relates generally to knitted cuff members of the type utilized in socks, wrist bands, leg warmers and the like and to a method of knitting same. More particularly, the present invention relates to a tubular circularly-knitted cuff member for an anklet-type sock and to a method of knitting same.

In recent years, anklet-type socks for dress and casual wear have become fashionable and are in great demand, particularly in women's and children's wear. Such anklet-type socks typically include a full foot portion but essentially no leg portion other than a short cuff portion worn about the ankle of the wearer. Such socks thereby cover substantially only the portion of the wearer's foot which is enclosed by the wearer's shoes leaving substantially all of the wearer's legs about the ankles exposed, whereby such socks are considered desirable for casual wear with shorts, skirts and the like. The cuff portions of such anklet-type socks typically are elasticized to retain the cuff portions against slippage into the wearer's shoes. It is also considered desirable that the cuff portions of such socks have some decorative quality to enhance the fashionableness thereof.

It is accordingly an object of the present invention to provide a new and novel knitted cuff portion for use in anklet-type socks as well as other similat knitted goods. It is a further object of the present invention to provide a novel knitted construction for and method of knitting such cuff portion to enable it to assume a relaxed condition to serve as an anklet-type cuff portion as well as an elongated condition to serve as an ordinary leg portion. Another object of the present invention is to provide such cuff portion with sufficient elasticity to prevent undesirable slippage on the wearer's ankle or leg, as well as to provide a pleasing decorative appearance to the cuff portion.

SUMMARY OF THE INVENTION

Briefly described, the present cuff member is of a tubular circularly-knitted construction having a plurality of circumferentially-extending rib portions and a plurality of circumferentially-extending connecting portions integrally knit with one another in axially alternating arrangement along the cuff member. Each rib portion is of a terry pile fabric construction having a radially-outwardly rounded terry loop surface and each connecting portion is of a plain non-terry fabric construction. The cuff member is stretchable axially between a relaxed condition wherein the rib portions are disposed closely axially adjacent one another and the connecting portions are generally not visible from outwardly of the cuff member and an extended condition wherein the ribbed portions and the connecting portions are elongated with the rib portions spaced axially from one another.

In the preferred embodiment, the cuff member includes a ground yarn, a terry yarn and an elastic yarn knitted in circumferential courses and axial wales. Each rib portion extends coursewise and includes a plurality of courses having in each thereof the ground yarn and the terry yarn knitted in plasted relationship in a terry pile stitch construction, with the elastic yarn inlaid periodically in the stitches of the ground and terry yarns to form the terry loop surface of a radially-outwardly rounded configuration. Each connecting portion also extends coursewise and includes a plurality of courses having in each thereof the ground yarn knitted in a single jersey stitch construction and the elastic yarn inlaid periodically in the stitches of the ground yarn.

Preferably, the ground yarn is a stretchable yarn of relatively low denier, e.g. stretch nylon, and the terry yarn is a non-stretchable yarn of relatively high denier, e.g. polyester yarn. It is also preferred that the elastic yarn be inlaid in alternate wales in every course throughout the cuff portion in a one-by-one mock rib fashion. In one embodiment, the terry loop surfaces of the rib portions include walewise aligned areas of terry loops and walewise aligned non-terry areas, while in another embodiment the terry loops surfaces of the rib portions are substantially entirely covered with terry loops. The cuff member is preferably embodied in an anklet-type sock, although it may also be readily embodied in other knitted articles.

The present invention also provides a method of circularly-knitting the tubular cuff member on a circular knitting machine of the type having respective circles of movable knitting needles and terry-type sinkers having upper and lower loop forming surfaces. Basically, the method is carried out by progressively repeating the steps of forming a plurality of courses of a terry pile fabric construction and a plurality of courses of a non-terry jersey fabric construction. The terry pile fabric construction is formed by feeding the ground yarn to substantially all the needles and to the lower surfaces of substantially all the sinkers, feeding the terry yarn to substantially all of the needles and to the upper surfaces of at least selected ones of the sinkers and to the lower surfaces of the other sinkers, and feeding the elastic yarn to only selected spaced ones of the needles. The needles and sinkers are manipulated to knit the ground and terry yarns in plated relationship in needle loops thereof on substantially all the needles, in terry pile loops of the terry yarn on the upper surfaces of the selected sinkers, in sinker loops of the ground yarn on the lower surfaces of the sinkers and in sinker loops of the terry yarn on the lower surfaces of the non-selected sinkers, and to inlay the elastic yarn in the needle loops of the ground and terry yarns on the selected needles. The non-terry jersey fabric construction is formed by feeding the ground yarn to substantially all the needles and the to lower surfaces of substantially all of the sinkers and feeding the elastic yarn to only selected spaced ones of the needles. The needles and the sinkers are manipulated to knit the ground yarn in needle loops on the needles and sinker loops on the lower surfaces of the sinkers and to inlay the elastic yarn in the needle loops of the ground yarn on the selected needles.

The number of terry courses and the number of jersey courses are selectively predetermined to form with each plurality of terry courses one aforedescribed rib portion with a rounded terry loop surface and to form a connecting portion with each plurality of jersey couses, and furthermore to adapt the cuff member for walewise stretching between the aforesaid relaxed and elongated conditions. In one preferred embodiment of the method, substantially all of the sinkers are selected for receiving the terry yarn on the upper surfaces thereof to form substantially the entire outer surface of each rib portion formed by each plurality of terry courses with terry loops. In another embodiment of the method, only spaced groups of the sinkers are selected for receiving the terry yarn over their upper surfaces to provide walewise aligned terry loop areas and walewise aligned non-terry areas on the outward surfaces of each rib portion formed by each plurality of terry courses. Preferably, the method includes the knitting of a socktype foot portion integrally with the cuff member to form the aforementioned preferred anklet-type sock.

DESCRIPTION OF THE PREFERRED EMBODIMENT

Figure 1:
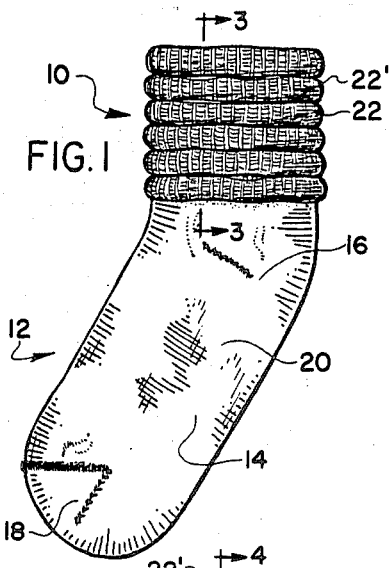
FIG. 1 is a side elevational view of the cuff member of the present invention as preferably embodied in an anklet-type sock, showing the cuff member in its relaxed condition.
Figure 2:
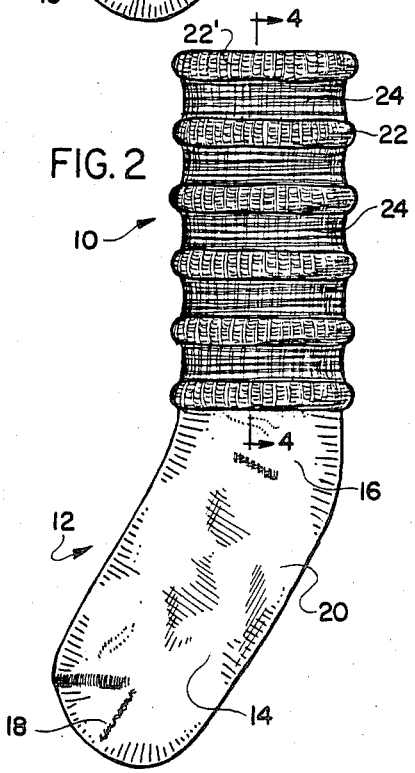
FIG. 2 is another side elevational view of the cuff member and sock of FIG. 1, showing the cuff member in its elongated condition.

Referring now to the accompanying drawings and initially to FIGS. 1 and 2, one embodiment of the cuff member of the present invention is indicated generally at 10 as preferably embodied in an anklet-type children's sock indicated generally at 12. However, it is to be understood that the cuff member 10 of the present invention may be equally well adapted for use in a wide variety of other knitted articles, e.g., wrist bands, leg warmers, etc.

The sock 12 is circularly knitted as hereinafter more fully explained and basically included a foot portion 14 integrally knit to one end of the cuff member 10. The foot portion 14 is of a conventional construction having reciprocally-knitted heel and toe pockets 16, 18 at the opposite ends of the foot portion 14 with a substantially tubular length of knitted fabric 20 extending therebetween, whereby the foot portion 14 is contoured in generally the same shape as the human foot.

The cuff member 10 is substantially tubular and basically includes several annular circumferentially-extending rib portions 22 and several annular circumferentially-extending connetion portions 24 integrally knit with one another in axially alternating arrangement along the cuff member 10. As more fully explained hereinafter, each of the rib portions 22 is of a terry pile fabric construction having a radilly outwardly rounded terry loop surface 22', while each of the connecting portions 24 is of a plain non-terry fabric construction. The cuff member 10 is of a particular knitted construction to be described by which the cuff member 10 is stretchable axially between a relaxed condition shown in FIG. 1 wherein the rib portions 22 are disposed closely axially adjacent one another making the connecting portions 24 generally not visible from outwardly of the cuff member 10 and an extended or elongated condition shown in FIG. 2 wherein the rib portions 22 and the connecting portions 24 are elongated with the rib portions 22 spaced axially from one another.

The sock 12 is preferably knitted on a circular hosiery knitting machine as more fully explained hereinafter and includes a plurality of yarns formed in needle, sinker and terry loops extending in a plurality of circumferential courses and axial wales. The sock 12 is knitted throughout the entirety thereof of a ground yarn G knitted in a single jersey stitch construction. In the cuff member 10, the rib portions 22 are formed in several spaced groups of courses each including a plurality of successive courses, with the connecting portions 24 being formed in the spaced groups of successive courses intermediate the course groups forming the rib portions 22. In the rib portions 22 of the cuff member 10, a terry yarn T is knitted in plated relationship with the ground yarn G in a terry stitch construction to form a set of terry pile loops $T_t$ on the so-called "reverse" side of the knitted fabric. In the connecting portions 24 of the cuff member 10, the terry yarn T is omitted and only the ground yarn G is knitted. Throughout the cuff member 10, an elastic yarn E is inlaid periodically on the reverse side of the knitted fabric in the stitch construction of each course in a mock-up fashion.

Preferably, the terry yarn T is a relatively bulky, high denier, non-stretchable so-called "set" yarn, while the ground yarn G is a relatively strong, low denier, stretchable yarn. It is believed important to the proper construction of the cuff member 10 as more fully explained hereinafter that the terry yarn be of a denier at least twice, and preferably several times, the denier of the ground yarn G. It has been found that a multi-filament, multi-ply, set polyester yarn is optimal for use as the terry yarn and a single stretchable nylon yarn is optimal for use as the ground yarn. As embodied in the anklet-type sock 12, the cuff member 10 utilizes a 600 denier set polyester yarn having two 300 denier polyester yarns plied together as the terry yarn and a single 70 denier stretch nylon yarn as the ground yarn.

Figure 5:
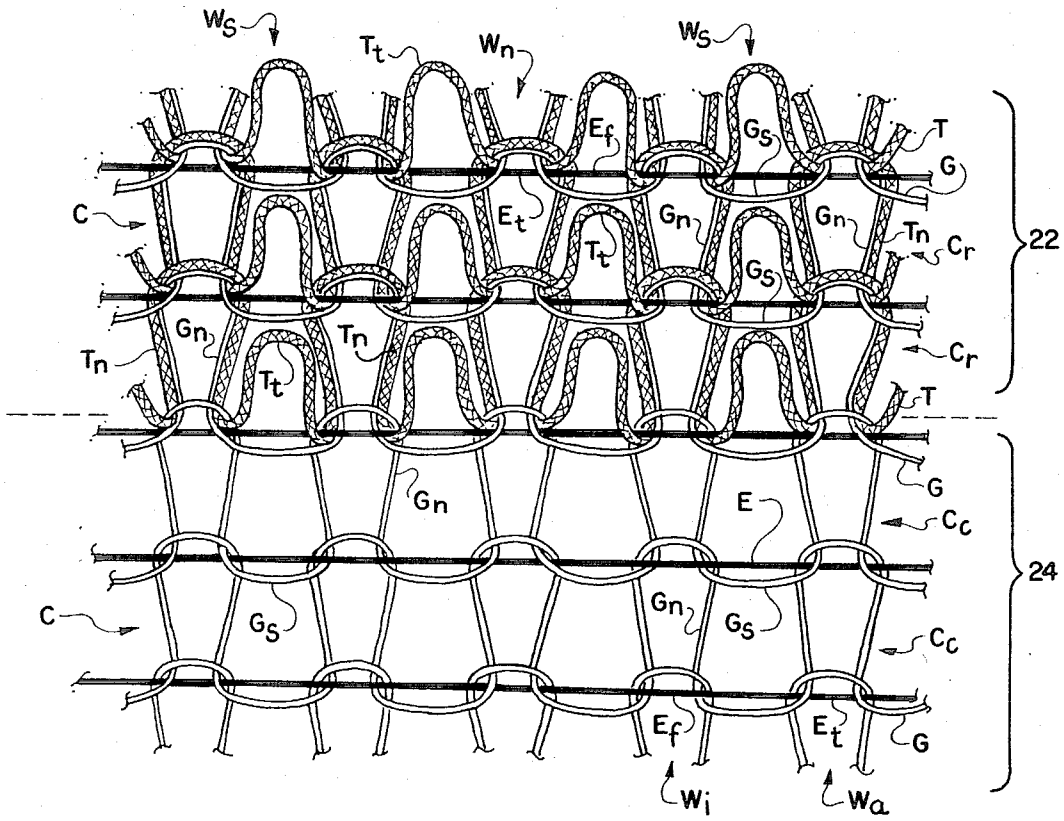
FIG. 5 is a schematic front elevational view of a portion of the cuff member of FIG. 1 at the juncture of a rib portion and an adjacent connecting portion thereof.

In FIG. 5, a substantially enlarged fragmentary portion of the knitted construction of the cuff member 10 is shown through several courses C and needle and sinker wales $W_n$,$W_s$ of the cuff member 10 at the juncture between one rib portion 22 and the adjacent connecting portion 24. In the courses $C_r$ in the rib portion 22, the terry yarn T and the ground yarn G are knitted in a terry stitch construction having the terry and ground yarns T,G formed in plated relationship to one another in respective needle loops $T_n$,$G_n$ in each needle wale $W_n$ of each course $C_r$, with the ground yarn G being formed in sinker loops $G_s$ and the terry yarn T being formed in elongated terry loops $T_t$ in each sinker wale $W_s$ of each course $C_r$. In the courses $C_c$ in the connecting portion 24, only the ground yarn G is knitted in a plain single jersey stitch construction of needle loops $G_n$ in each needle wale $W_n$ of each course $C_c$ and in sinker loops $G_s$ in each sinker wale $W_s$ of each course $C_c$. The elastic yarn E is inlaid on the reverse side of the fabric throughout each course $C_r$,$C_c$ in both the rib portion 22 and the connecting portion 24 in a one-by-one (1×1) mock rib construction having the elastic yarn E formed in tuck stitches $E_t$ in the needle loops $T_n$,$G_n$ in alternate needle wales $W_a$ and in float stitches $E_f$ extending across the needle loops $T_n$,$G_n$ of the intermediate needle wales $W_i$. Although the elastic yarn E may be inlaid in the needle loops $G_n$,$T_n$ in other mock rib constructions, it has been found that a one-by-one (1×1) mock rib is optimal.

Figure 6:
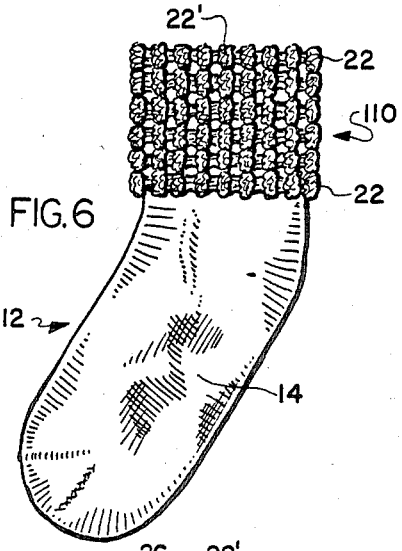
FIG. 6 is a side elevational view of another embodiment of the cuff member of the present invention also embodied in an anklet-type sock, showing the cuff member in its relaxed condition.
Figure 7:
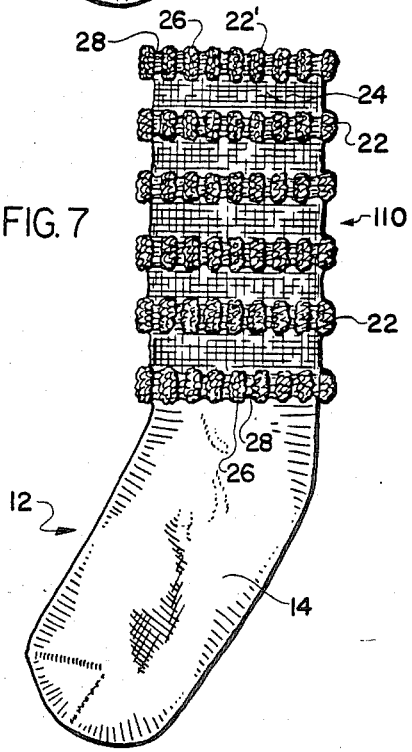
FIG. 7 is another side elevational view of the cuff member and sock of FIG. 6, showing the cuff member in its elongated condition.
Figure 8:
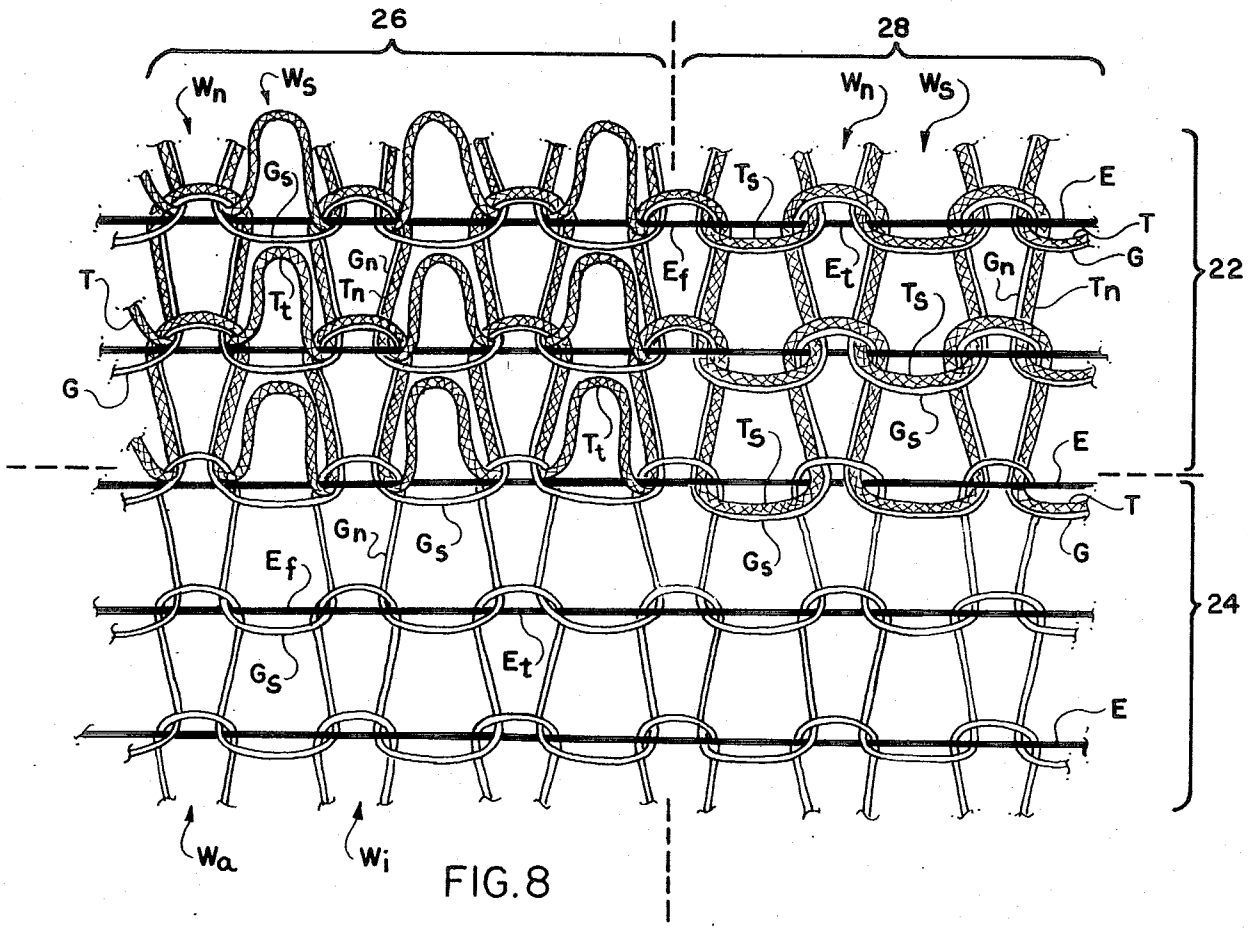
FIG. 8 is a schematic front elevational view of a portion of the cuff member of FIG. 6 at the juncture between a rib portion and an adjacent connecting portion thereof, showing the juncture of a terry area and an adjacent non-terry area of the rib portion.

As may be desirable, differently colored terry yarns T may be utilized respectively in the courses $C_r$ of the several rib portions 22 to produce a horizontally-striped appearance of the cuff member 10. As illustrated in FIGS. 6 and 7, it is also contemplated that a modified cuff member 110 may be selectively provided with a walewise ribbed appearance by forming the terry yarn or yarns in terry loops in only selected spaced walewise aligned areas of the rib portions 22, as indicated at 26 in FIGS. 6 and 7, with the intermediate walewise aligned areas being of a non-terry stitch construction, as indicated at 28 in FIGS. 6 and 7. In FIG. 8, a substantially enlarged fragmentary portion of the knitted construction of the cuff member 110 is shown through several courses C and needle and sinker wales $W_n$,$W_s$ of the cuff member 110 at the juncture between one rib portion 22 and the adjacent connecting portion 24, showing the juncture between one terry loop area 26 and the adjacent non-terry area 28 of the rib portion 22. In the courses $C_r$ of the rib portion 22, the ground and terry yarns G,T are knitted in plated relationship, with the terry yarn T being formed in terry loops $T_t$ in selected spaced group of successive sinker wales $W_s$ while being formed in sinker loops $T_s$ in the remaining intermediate groups of successive sinker wales $W_s$. In this manner, the groups of sinker wales $W_s$ in which the terry yarn T is formed in terry loops $T_t$ produce the walewise aligned terry loop areas 26 and the spaced groups of sinker wales $W_s$ in which the terry yarn T is formed in sinker loops $T_s$ produce the walewise aligned non-terry areas 28, whereby the cuff member 110 has the aforementioned walewise ribbed appearance. In the courses $C_c$ in the connecting portions 24 of the cuff member 110, the ground yarn G is formed in the same single jersey stitch construction of needle and sinker loops $G_n$,$G_s$ as in the embodiment of the cuff member 10 of FIGS. 1, 2 and 5. Likewise, the elastic yarn E is inlaid throughout the rib and connecting portions 22,24 of the cuff member 110 in a one-by-one (1×1) mock rib construction of alternating tuck and float stitches $E_t$,$E_f$, also as in the cuff member 10 of FIGS. 1, 2 and 5.

The ground yarn G is also knit throughout the foot portion 14 of the sock 12 in the same single jersey stitch construction of needle and sinker loops $G_n$,$G_s$. To provide added bulk and cushioning for the foot of the wearer, a bulkier, higher denier body yarn (not shown) is knitted in plated relationship with the ground yarn G in the same single jersey stitch construction throughout the foot portion 14. The elastic yarn E is preferably omitted from the foot portion 14. A wide variety of yarns may be utilized as the body yarn as desired. In the preferred embodiment of the children's sock 12, a two-ply stretchable nylon yarn is utilized as the body yarn. However, as those persons skilled in the art will recognize, it may be desirable to utilize an absorbent yarn such as cotton, wool or acrylic as the body yarn in other types of socks or knitted articles, particularly if intended for athletic use.

Turning now to the knitting method of the present invention by which the cuff member 10 is formed, and with particular reference to FIGS. 9–14, the present method, as preferably embodied for forming the cuff member 10 in the sock 12, is performed on a circular knitting machine of the hosiery type having the capability for both rotational and reciprocal knitting motions together with the capacity for knitting terry-type fabrics. Circular knitting machines of this basic type are conventional and known and, therefore, for clarity and succinctness of the illustration and description of the present method, the knitting machine and its operation are illustrated herein only insofar as is necessary to facilitate a complete understanding of the method of the present invention.

The knitting machine basically includes a rotatable needle cylinder (not shown) of a relatively small diameter with axial needle slots formed about the outer circumferential surface of the cylinder. A plurality of latch-type knitting needles 30, each having a yarn-receiving hook 32 and a closable latch assembly 34 are reciprocably disposed with the axial cylinder slots. A sinker ring (also not shown) having a plurality of radial slots formed thereabout is disposed annularly and coaxially about the upper end of the needle cylinder for synchronous rotation therewith. A plurality of loop-forming sinkers 36 are reciprocably carried in the radial slots of the sinker ring for movement of the sinkers 36 transversely of and between the cylinder needles 30. The sinkers 36 are of the known terry-type having a lower basic yarn receiving surface 38 and an upper raised yarn receiving surface 40 over which sinker loops and terry pile loops, respectively may be formed during plated knitting of two yarns to facilitate the formation of the above-described terry-type construction of the rib portions 22 of the cuff member 10.

The needles 30 and sinkers 36 are operably manipulated within the cylinder and sinker ring slots, respectively, by stationary needle and sinker cams positioned adjacent the needle cylinder and sinker ring to engage and act on cam butts 42,44 formed respectively on the needles 30 and the sinkers 36 during rotation of the needle cylinder and sinker ring. The knitting machine has a single knitting station, although as those persons skilled in the art will readily recognize the present method may be equally adapted to be performed by multi-station knitting machines. The needle cams are arranged in conventional fashion to manipulate each needle 30 to an active raised yarn receiving position within the cylinder slots to project axially from the upper end of the needle cylinder as the needles 30 pass the location of the knitting station during the rotation of the needle cylinder and to manipulate the needles 30 to be axially withdrawn within the cylinder slots immediately after the needles 30 pass the knitting station during rotation of the needle cylinder. The sinker cams are similarly arranged to manipulate the sinkers 36 radially relative to the needles 30 at the location of the knitting station, as more fully explained hereinafter.

A plurality of yarn feeding fingers (not shown) are pivotably movable into and out of yarn feeding positions at the upper end of the needle cylinder at the location of the knitting station to feed the ground and terry yarns G,T and the body yarn to the needles 30 and the sinkers 36 at the knitting station. One of the yarn feeding fingers is adapted to feed the terry yarn T at a terry yarn feeding level relative to the needles 30 and the sinkers 36, indicated at $L_t$, for receipt within the open hook and latch areas of the raised needles 30 and for receipt by the sinkers 36 over their upper raised yarn received surfaces 40. If more than one terry yarn T is utilized, each other terry yarn T is similarly fed by another respective terry yarn feeding finger adapted for independent pivotal movement to feed the associated terry yarn T at the terry yarn feeding level $L_t$. The ground yarn G is fed by another yarn feeding finger adapted to feed the ground yarn G at a non-terry yarn feeding level relative to the needles 30 and the sinkers 36, indicated at $L_g$, to the open hook and latch areas of the raised needles 30 and for receipt by the sinkers 36 over their lower yarn receiving surfaces 38. In the preferred embodiment, the body yarn is fed by the same feed finger as the ground yarn G through a slightly elevated yarn feed opening therein, the feed finger being selectively positionable at one feeding position wherein only the lower feed opening for the ground yarn G is at the feeding level $L_g$ and the elevated feed opening for the body yarn misses above the needles 30 or at another feeding position wherein the lower feed opening is at a feeding level slightly below the level $L_g$ and the elevated feed opening is at a level to feed the both yarns to the needles 30. However, as those persons skilled in the art will recognize, the body yarn may also be fed through a separate independent yarn feeding finger as necessary or desirable. An elastic yarn feeding finger (not shown) is also provided at a spacing from the knitting station for feeding the elastic yarn E, the needle cams at the corresponding location being adapted for partially raising selected needles to a so-called tuck position for receiving the elastic yarn E. A yarn cutting mechanism or device (not shown) is provided on a dial plate or similar member positioned stationarily within the cylinder at its upper end to cut and hold the yarns when they are taken out of feeding and knitting operation.

For selective design capabilities, the sinkers 36 may be of either the so-called "long butt" type having a cam butt 44' which extends from the sinker 36 to a relatively greater degree or may be of the so-called "short butt" type having a cam butt 44" which extends from the sinker 36 to a relatively lesser degree. The sinker cams are contained within a so-called sinker cap (not shown) which is mounted on the sinker ring and is operatively positionable at either a fully active position adjacent the sinker ring for full active manipulative contact with the sinker butts 44 whether of the long or short type for terry-knitting operation or at an intermediate partially active position adjacent the sinker ring for active manipulative sinker operation on only the sinkers 36 having long butts 44' or at an inactive position out of manipulative contact with all of the sinker butts. The needles 30 similarly may be of either a long butt or a short butt type for selective raising of spaced ones of the needles 30 to the tuck position for receiving the elastic yarn E.

The knitting machine is operable to carry out the knitting of the sock 12 in conventional manner from the cuff member 10 to the foot portion 14 and an appropriate control arrangement is provided for determining the necessary transitonal changes in the machine operation to form each portion of the cuff member 10 and the sock 12.

In forming the cuff member 10 of FIGS. 1, 2 and 5, the sinkers 36 and the sinker cams are cooperatively arranged for full active manipulation of all sinkers 36 by the sinker cams for terry-knitting operation, either by positioning the sinker cap at the fully active position or by utilizing long butt type sinkers 36 in every slot of the sinker ring and cooperatively positioning the sinker cap at the partially active position.

In accordance with the normal operation of the knitting machine as previously mentioned, the sock 12 is knit progressively from the cuff member 10 through the foot portion 12 and is completed with the knitting of the toe pocket 18. To begin the operation of the machine, alternate ones of the needles 30 are raised to the so-called tuck position at the elastic yarn feeding finger while the intermediate needles 30 remain inactively withdrawn within the needle cylinder and the elastic yarn E is fed to the alternate needles 30 for several initial revolutions of the needle cylinder. During these initial machine revolutions, the yarn feeding fingers carrying the ground and terry yarns are pivoted out of yarn feeding position at the knitting station. Thereafter, all of the needles 30 are raised to the active yarn receiving position at the knitting station and the yarn feeding fingers carrying the ground and terry yarns are pivoted into their feeding positions at the knitting station to feed the terry yarn T and the ground yarn G to the needles 30 and the sinkers 36 for knitting in plated relationship in a terry stitch construction. During the first such revolution of the needle cylinder following the formation of the make-up rounds of elastic yarn E, a first circumferential course of needle, sinker and terry loops of the terry and ground yarns T,G are formed, the make-up of the rounds of the elastic yarn E being shed from the needles 30 and the needle loops of the terry and ground yarns T,G being formed around and encircling the elastic make-up rounds in conventional manner. For such revolution and a plurality of subsequent revolutions of the needle cylinder, the alternate needles continue to be raised to the tuck position at the elastic yarn feeding finger in advance of the knitting station to receive the elastic yarn E, following which the feeding and knitting of the terry and ground yarns T,G in terry stitch construction proceeds at the knitting station as above-described during each cylinder revolution to form the initial rib portion 22 of the cuff member 10.

Figure 9:
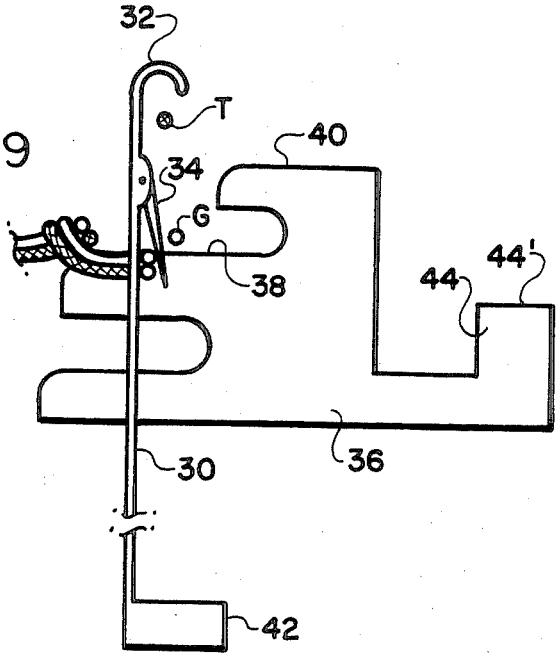
FIGS. 9–13 schematically illustrate the knitting action of the needles and sinkers at various stages in forming the cuff member of FIG. 1 according to the knitting method of the present invention.
Figure 10:
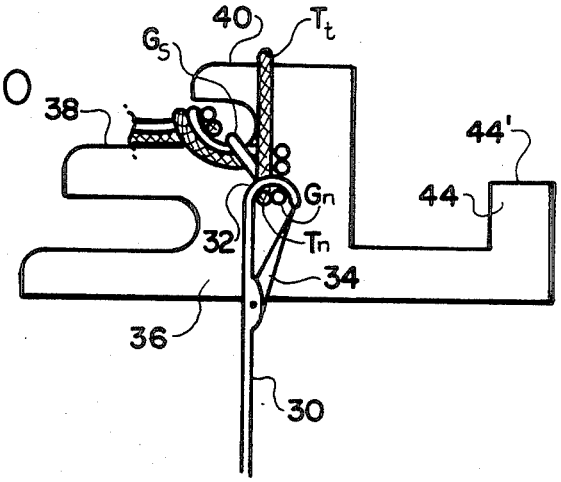
Figure 13:
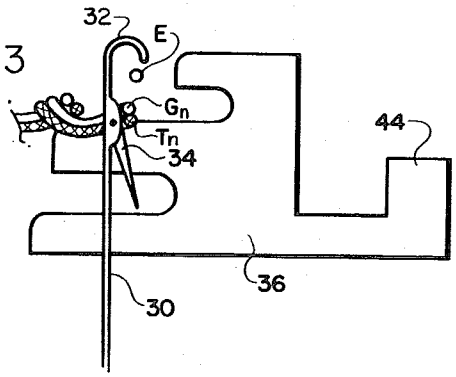

The knitting action of the needles 30 and sinkers 36 during the knitting of the initial rib portion 22 is shown and will be more particularly understood with reference to FIGS. 9, 10 and 13. In FIG. 7, a representative needle 30 is shown at the active raised yarn receiving position during its movement past the knitting station. The terry yarn T is fed at the terry yarn feeding level $L_t$ and the ground yarn G is fed at the non-terry yarn feeding level $L_g$, both yarns T,G being thereby received within the open hook and latch area of the needle 30. The terry yarn T at the terry yarn feeding level $L_t$ is thus located above the level of the upper raised yarn receiving surface 40 of the associated adjacent sinker 36, while the ground yarn G at the non-terry yarn feeding level $L_g$ is located below the upper yarn receiving surface 40 but above the lower yarn receiving surface 38 of the sinker 36. Notably, the sinker 36 remains radially outwardly withdrawn with respect to the needle 30 to permit the ground yarn G to be inserted between the needle 30 and the sinker 36 onto the lower yarn receiving surfacer 38 of the sinker 36.

FIG. 10 illustrates the same needle 30 and associated sinker 36 at the subsequent point in the rotation of the needle cylinder and sinker ring at which the needle 30 has been fully withdrawn in the needle cylinder by the needle cams and the associated sinker 36 has been extended radially inwardly with respect to the needle 30. Thus, the needle 30 has drawn plated needle loops $T_n$,$G_n$ of the terry and ground yarns T,G which are held within the closed hook and latch area of the needle 30. The sinker loop $G_s$ of the ground yarn G extends over the lower yarn receiving surface 38 of the sinker 36 and a terry pile loop $T_t$ of the terry yarn T extends over the upper raised yarn receiving surface 40 of the sinker 36. Assuming the same needle 30 is one of the selected long butt alternate needles to receive the elastic yarn E, FIG. 13 illustrates the same needle 30 and the associated sinker 36 at the subsequent point in the rotation of the needle cylinder and sinker ring at the location of the elastic yarn feeding finger. The needle cams have again raised the needle 30 to the so-called tuck position at which the previously formed needle loops $T_n$,$G_n$ of the terry and ground yarns T,G have opened the latch assembly 34 of the needle 30 but have not been cast below the open latch 34 and therefore remain within the open hook and latch area. The sinker 36 is radially outwardly withdrawn with respect to the needle 30 and the elastic yarn E is fed to the open hook and latch area of the needle 30, whereby a tuck stitch $E_t$ (FIG. 5) of the elastic yarn E will be inlaid in the needle loops $T_n$,$G_n$ of the terry and ground yarns T,G as the needle 30 and the sinker 36 are passed once again through the knitting station during the next machine revolution to receive and knit another terry stitch of the terry and ground yarns T,G. As will be understood, the two adjacent needles 30 on opposite sides of the needle 30 shown in FIG. 13 are not acted on by the needle cams at the location of the elastic yarn feeding finger and therefore remain axially withdrawn within the needle cylinder and do not receive the elastic yarn E, whereby the elastic yarn E will form a float switch $E_f$ (FIG. 5) across the needle loops $T_n$,$G_n$ of the terry and ground yarns T,G as such non-selected intermediate needles 30 form the next successive needle loops $T_n$,$G_n$ of the terry and ground yarns T,G at the knitting station as the rotation of the needle cylinder proceeds.

Following the completion of a predetermined number of revolutions of the needle cylinder for the knitting of the first rib portion 22 as above-described, the control arrangement of the knitting machine pivots the yarn feeding finger for the terry yarn T out of yarn feeding position. As is conventional, the last needle receiving the terry yarn T directs it into the cutting mechanism of the knitting machine as such last needle continues to rotate with the knitting cylinder. The yarn feeding finger carrying the ground yarn G and the elastic yarn feeding finger carrying the elastic yarn E remain in their same respective yarn feeding positions and the needle and sinker cams continue to manipulate the needles 30 and the sinkers 36 in the same manner as during the preceding revolutions of the knitting machine in knitting the first rib portion 22. Thus, the ground yarn G is knitted at the knitting station by the needles 30 and the sinkers 36 in the same single jersey stitch construction as above-described during each such cylinder revolution but the terry yarn T is not received and is not knitted by any of the needles 30 and sinkers 36. The elastic yarn E also continues to be inlaid in alternate needle loops $G_n$ of the ground yarn G during each such cylinder revolution to provide the jersey fabric of the ground yarn G with a one-by-one ($1\times1$) mock-rib construction also as above-described. In this manner, the first connecting portion 24 is knitted integrally with the first rib portion 22.

Figure 12:
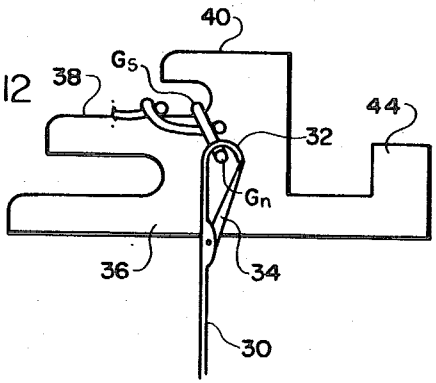
Figure 11:
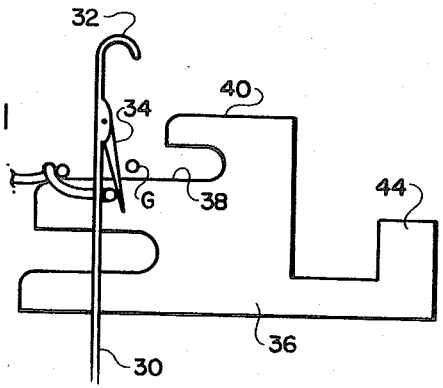

The basic knitting action of the individual needles and sinkers 30,36 during each revolution in the knitting of the first connecting portion 24 is illustrated in FIGS. 11 and 12. In FIG. 11, a needle 30 is shown at the active raised yarn receiving position during its movement past the knitting station and the associated sinker 36 is radially outwardly withdrawn with respect to the needle 30, with only the ground yarn G being fed to the open hook and latch area of the needle 30 and onto the lower yarn receiving surface 38 of the associated sinker 36. FIG. 12 illustrates the same needle 30 and associated sinker 36 at the subsequent point in the rotation of the needle cylinder and sinker ring at which the needle 30 has been fully withdrawn in the needle cylinder by the needle cams and the associated sinker 36 has been extended radially inwardly with respect to the needle 30 by the sinker cams. The needle 30 has thus drawn a needle loop $G_n$ of the ground yarn G which is held within the closed hook and latch area of the needle 30, and a sinker loop $G_s$ extends over the lower yarn receiving surface 38 of the associated sinker 36. The elastic yarn E is fed to the alternate needles 30 for inlaying in alternate needle loops $G_n$ of the ground yarn G in the same manner as shown in FIG. 13 and described above during the knitting of the rib portion 22. As previously indicated, the knitting machine is operated in this manner for a predetermined number of revolutions sufficient to knit a plurality of jersey courses of the ground yarn G to form the first connecting portion 24 of a sufficient walewise length to dispose the first rib portion 22 in closely adjacent disposition with the next successive rib portion 22 with the connecting portion 24 being generally non-visible from outwardly of the cuff member 10 when in its relaxed condition.

Following the completion of the last revolution of the needle cylinder during formation of the first connecting portion 24, several successive additional rib portions 22 and connecting portions 24 are alternately formed in the same manner as described above for the first rib and connecting portions 22,24 to produce the cuff member 10 of a desired length. As previously mentioned, differently colored terry yarns T may be utilized in the other rib portions 22 to produce a coursewise striped appearance of the cuff member 10. Following the completion of the last revolution of the needle cylinder during the formation of the last rib portion 22, the knitting machine control arrangement actuates movement of the terry yarn feeding finger operative during the knitting of the last rib portion 22 as well as the elastic yarn feeding finger to respective non-feeding positions and simultaneously activates pivotal movement of the yarn feeding finger for the body yarn into yarn feeding position, with the yarn feeding finger for the ground yarn G continuing uninterrupted in active yarn feeding operation. With the preferred use of the same feeding finger for feeding the ground yarn G and the body yarn, this feeding finger is pivoted to a sufficiently greater extent into yarn feeding position to lower the body yarn to a level within the open hook and latch areas of the active raised needles to be received thereby simultaneously with the ground yarn G, as aforedescribed. At the same time, the sinker cap is moved to its inactive position to avoid radially inward manipulation of the sinkers to insure receipt of the body yarn on the lower and not upper surfaces of the sinkers thereby to avoid formation of terry loops of the body yarn. In this manner, the ground yarn G and the body yarn B are knitted in plated relationship by all of the needles 30 and sinkers 36 to form plated needle loops of the ground and body yarn within the hook and latch areas of the needles 30 and plated sinker loops of the ground and body yarns over the lower yarn receiving surfaces 38 of the sinkers 36. Following the operation of the knitting machine in this manner for a predetermined initial number of revolutions, the control arrangement of the machine deactivates rotational operation of the needle cylinder and sinker ring and activates reciprocal operation thereof utilizing only a portion of the needles and the associated sinkers to knit a number of partial courses of the ground and body yarns to form the contoured heel pocket 16 in conventional manner. Thereafter, the rotational operation of the knitting machine is resumed for a predetermined subsequent number of revolutions of the needle cylinder and sinker ring to form the main tubular length 20 of the foot portion 14, after which the machine is returned to reciprocal operation to form the contoured toe pocket 18 to complete the knitting of the sock 12. As will be understood, the toe pocket 18 of the sock 12 as completed on the knitting machine is of the open so-called "fish mouth" type which is seamed closed in a subsequent sewing operation to complete the formation of the sock 12 as shown in FIG. 1.

Figure 14:
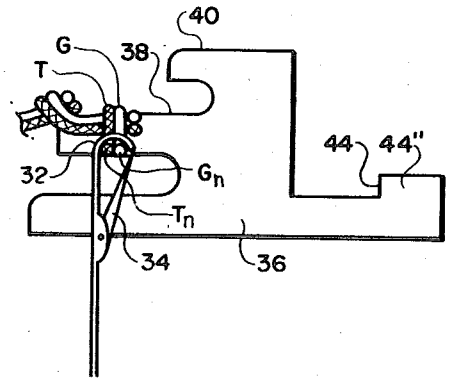
FIG. 14 illustrates the knitting action of the needles and sinkers at a stage in forming the cuff member of FIG. 6 according to another embodiment of the knitting method of the present invention.

The method of knitting the cuff member 110 of FIGS. 6 and 7 is substantially identical to the above-described method for knitting the cuff member 10 except that, in the formation of each rib portion 22, only selected spaced groups of successive needles 30 and the associated sinkers 36 are operative for forming the terry loops $T_t$ of the terry yarn T with the remaining intermediate groups of successive needles 30 and associated sinkers 36 being operative for knitting the terry yarn T in a single jersey stitch construction identical to that of the ground yarn G. This is accomplished by positioning the sinker cap at the intermediate partially active position and utilizing long butt sinkers 36 as the selected sinkers of each group designated for terry stitch formation while utilizing short butt sinkers 36 as the non-selected sinkers of each group designated for single jersey stitch formation. In this manner, during each revolution of the knitting machine in the formation of the rib portions 22 of the cuff member 110, the long butt sinkers 36 are manipulated radially with respect to their associated needles 30 in the same manner as illustrated in FIGS. 9 and 10 to form plated needle loops $G_n$,$T_n$ of the ground and terry yarns G,T in the hook and latch area of each associated needle and a sinker loop $G_s$ and terry loop $T_t$ of the ground and terry yarns G,T respectively over the lower and upper yarn receiving surfaces 38,40 of each long butt sinker 36. On the other hand, the sinker cams of the sinker cap are inoperative on the short butts 44" of the non-selected sinkers 36 so that such short butt sinkers 36 are not manipulated radially inwardly with respect to their associated needles 30 during stitch formation by the needles 30 as shown in FIG. 10. Instead, as shown in FIG. 14, the short butt sinkers 36 remain radially outwardly withdrawn with respect to their associated needles 30 whereby, when the associated needles 30 are manipulatively withdrawn within the needle cylinder for stitch formation, the terry yarn T is not formed over the upper raised yarn receiving surfaces 40 of the short butt sinkers 36 but instead is merely formed as a plated sinker loop $T_s$ of the terry yarn T over the lower yarn receiving surfaces 38 of the short butt sinkers 36 in the same manner as the ground yarn G. Thus, the aforementioned walewise aligned terry and non-terry areas 26,28 are formed in the rib portions 22 of the cuff member 110.

Figure 3:
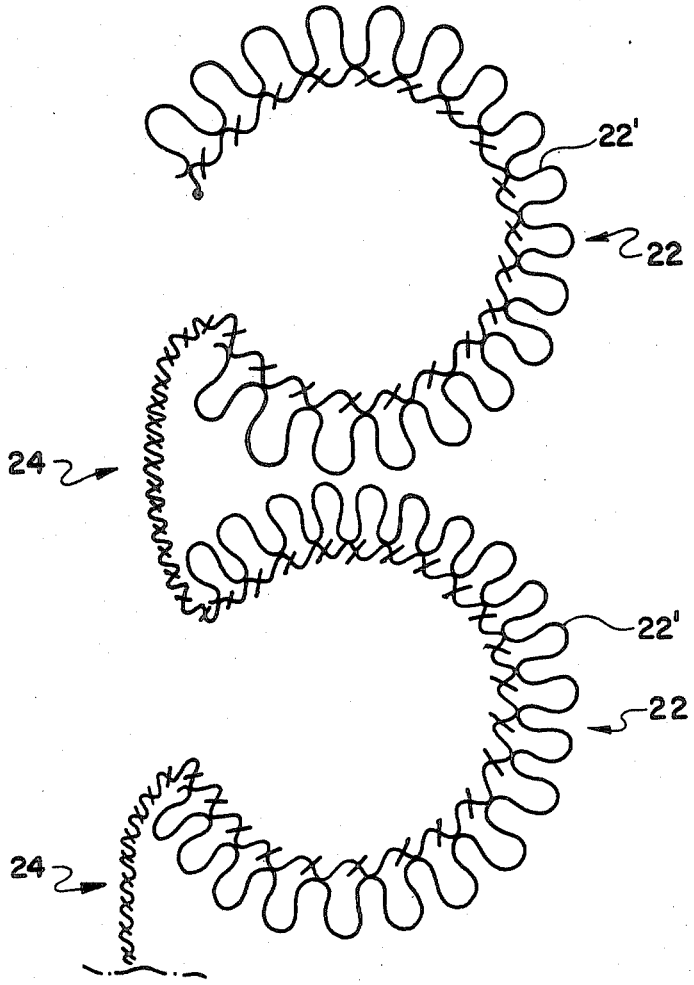
FIG. 3 is a schematic vertical cross-sectional view of the relaxed cuff member of FIG. 1 taken along line 3—3 thereof.
Figure 4:
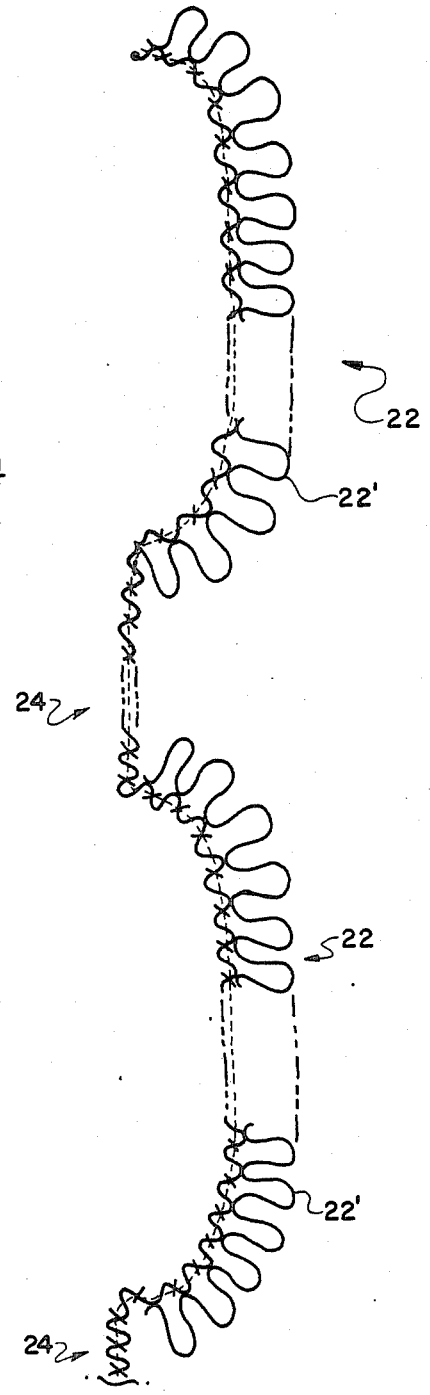
FIG. 4 is a schematic vertical cross-sectional view of the elongated cuff member of FIG. 2 taken along line 4—4 thereof.

The above-described construction of the cuff member 10 provides the cuff member 10 with several unique qualities. First, the use of both the elastic yarn E and the stretch nylon ground yarn G provides the cuff member 10 with significant degrees of both coursewise and walewise stretchability. In addition, the elastic and ground yarns E,G cause the rib portions 22 to contract walewise in the relaxed condition of the cuff member 10 and constrain the rib portions 22 to roll axially upon themselves on the face side of the fabric to give the terry loop surfaces 22' on the reverse side of the fabric the aforementioned rounded configuration. Notably, in contrast to conventional socks and other knitted articles, the tubular cuff members 10, 110 are intended to be worn with the face side of the knitted fabric construction disposed radially inwardly to present the terry loop surfaces 22' on the reverse side of the knitted fabric construction at the radially outwardly facing side of the cuff member 10,110. The connecting portions 24, being constructed essentially only of the low denier nylon ground yarn G with the elastic yarn E inlaid therein, have an open mesh construction in the nature of a knitted scrim of gauze-like fabric, whereby the connecting portions 24 contract in the relaxed condition of the cuff member 10,110 to an even greater extent than the rib portions 22. According to the present invention, each rib portion 22 is formed of a selected predetermined number of courses sufficient to enable the axial ends of each rib portion 22 to roll substantially together in the relaxed condition of the cuff member 10, and each connecting portion 24 is formed of a selected predetermined number of courses to permit the adjacent rib portions 22 to be disposed closely axially adjacent one another in the relaxed condition of the cuff member 10, as shown in FIGS. 1, 3 and 6, so that the connecting portions 24 are essentially nonvisible. In such relaxed condition, the cuff member 10 is very compact walewise to enable the cuff member 10 to serve as an anklet-type cuff for the sock 12. However, as mentioned, the cuff member 10 has a high degree of walewise stretchability enabling it to be elongated axially to the aforementioned extended condition, shown in FIGS. 2, 4, 7 with the rib and connecting portions 22,24 substantially elongated to dispose the rib portions 22 at an axial spacing from one another, whereby the cuff member 10,110 is adapted to function as an ordinary leg portion for the sock 12. Notably, in both the relaxed and extended conditions of the cuff member 10,110, the rib portions 22 maintain their outwardly rolled configuration to provide a unique and pleasing decorative appearance in each case.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A tubular circularly-knitted cuff member comprising a plurality of circumferentially-extending rib portions and a plurality of circumferentially-extending connecting portions integrally knit with one another in axially alternating arrangement along said cuff member, each said rib portion including a relatively stretchable, low denier ground yarn and a relatively non-stretchable, high-denier terry yarn knitted in plated relationship in a terry pile fabric construction causing said rib portion to project radially-outwardly and to be axially rounded with respect to said connecting portions and each said connecting portion including knitted stitches essentially only of said ground yarn knitted in a plain non-terry fabric construction, said cuff member being stretchable axially between a relaxed condition wherein said rib portions are disposed closely axially adjacent one another and said connecting portions are generally not visible from outwardly of said cuff member and an extended condition wherein said rib portions and said connecting portions are elongated with said rib portions spaced axially from one another.

2. A tubular circularly-knitted cuff member according to claim 1 and characterized further in that said terry loop surfaces of said rib portions include axially aligned areas of terry loops and axially aligned non-terry areas.

3. An anklet-type sock having a cuff member according to claim 1.

4. An anklet-type sock according to claim 3 and characterized further in that said sock includes a foot portion knitted in a single jersey stitch construction with the reverse side thereof on the radially outward surface of said foot portion.

5. A tubular circularly-knitted cuff member comprising a relatively stretchable, low denier ground yarn, a relatively non-stretchable, high denier terry yarn and an elastic yarn knitted in circumferential courses and axial wales, said cuff member comprising a plurality of coursewise extending rib portions and a plurality of coursewise extending connecting portions integrally knit with one another in axially alternating arrangement along said cuff member, each said rib portion including a plurality of courses having in each thereof said ground yarn and said terry yarn knitted in stitches in plated relationship in a terry pile stitch construction and said elastic yarn inlaid periodically in the stitches of said ground and terry yarns causing said rib portion to project radially-outwardly and to be axially rounded with respect to said connecting portions, each said connecting portion including a plurality of courses having in each thereof knitted stitches only of said ground yarn knitted in a single jersey stitch construction and said elastic yarn inlaid periodically in the stitches of said ground yarn to provide said connecting portions with a greater degree of elastic contractibility than said rib portions, said cuff member being stretchable axially between a relaxed condition wherein said rib portions are disposed closely axially adjacent one another and said connecting portions are generally not visible from outwardly of said cuff member and an extended condition wherein said rib portions and said connecting portions are elongated with said rib portions spaced axially from one another.

6. A tubular circularly-knitted cuff member according to claim 5 and characterized further in that said ground yarn is a stretchable yarn of relatively low denier and said terry yarn is a non-stretchable yarn of relatively high denier.

7. A tubular circularly-knitted cuff member according to claim 5 and characterized further in that said ground yarn is formed of nylon and said terry yarn is formed of polyester.

8. A tubular circularly-knitted cuff member according to claim 5 and characterized further in that said elastic yarn is inlaid in alternate wales in every course throughout said cuff portion.

9. An anklet-type sock having a cuff member according to claim 5.

10. An anklet-type sock having a cuff member according to claim 9 and characterized further in that said sock includes a foot portion knitted in a single jersey stitch construction with the reverse side thereof on the radially outward surface of said foot portion.

* * * * *

UNITED STATES PATENT AND TRADEMARK OFFICE

CERTIFICATE OF CORRECTION

PATENT NO. : 4,702,091

DATED : October 27, 1987

INVENTOR(S) : David S. Good and Daniel H. Good

It is certified that error appears in the above-identified patent and that said Letters Patent is hereby corrected as shown below:

Column 1, line 29: Delete "similat" and insert -- similar --.

Column 1, line 64: Delete "plasted" and insert -- plated --.

Column 2, line 47: Delete "the to" and insert -- to the --.

Column 2, line 58: Delete "couses" and insert -- courses --.

Column 3, line 59: Delete "included" and insert -- includes --.

Column 4, line 2: Delete "connetion" and insert -- connection --.

Column 4, line 6: Delete "radilly" and insert -- radially --.

Column 4, line 40: Delete "mock-up" and insert -- mock-rib --.

Column 5, line 39: Delete "group" and insert -- groups --.

Column 7, line 9: Delete "received" and insert -- receiving --

UNITED STATES PATENT AND TRADEMARK OFFICE

CERTIFICATE OF CORRECTION

PATENT NO. : 4,702,091

DATED : October 27, 1987

INVENTOR(S) : David S. Good and Daniel H. Good

It is certified that error appears in the above-identified patent and that said Letters Patent is hereby corrected as shown below:

Column 7, line 68: Delete "transitonal" and insert -- transitional --.

Column 10, line 38: After "closely" insert -- axially --.

Signed and Sealed this

Twentieth Day of March, 1990

*Attest:*

*Attesting Officer*

JEFFREY M. SAMUELS

*Acting Commissioner of Patents and Trademarks*